US005534672A

United States Patent [19]

Meagher

[11] Patent Number: 5,534,672

[45] Date of Patent: Jul. 9, 1996

[54] MULTIPLE PLUNGER PEDAL SWITCH ASSEMBLY

[75] Inventor: James P. Meagher, Indianapolis, Ind.

[73] Assignee: Emerson Electric Co., St. Louis, Mo.

[21] Appl. No.: 385,001

[22] Filed: Feb. 6, 1995

[51] Int. Cl.[6] ..... H01H 3/14

[52] U.S. Cl. ..... 200/61.89

[58] Field of Search ..... 200/16 R–16 F, 200/61.88, 61.89, 61.91; 218/1; 338/47, 108, 153; 340/479

[56] References Cited

U.S. PATENT DOCUMENTS

| | | | |
|---|---|---|---|
| 2,006,690 | 7/1935 | Blake | 290/38 R |
| 3,918,020 | 11/1975 | DuRocher | 200/16 R X |
| 4,046,980 | 9/1977 | Rosebrook | 200/573 |
| 4,205,434 | 6/1980 | Brozoski et al. | 200/522 |
| 4,227,060 | 10/1980 | Ayres et al. | 200/296 |
| 4,458,116 | 7/1984 | Kenny et al. | 200/61.89 |
| 4,853,556 | 8/1989 | Pfalzgraf | 200/61.89 X |
| 5,006,677 | 9/1991 | Smith et al. | 200/61.89 |
| 5,162,625 | 11/1992 | Comerford | 200/61.89 |
| 5,166,628 | 11/1992 | Henninger | 338/118 |
| 5,241,144 | 8/1993 | Meagher et al. | 200/61.89 |
| 5,321,219 | 6/1994 | Meagher et al. | 200/61.89 |
| 5,387,898 | 2/1995 | Yeheskel et al. | 340/479 |

*Primary Examiner*—J. R. Scott
*Attorney, Agent, or Firm*—Eric R. Waldkoetter

[57] ABSTRACT

A switch assembly has dual spring biased plungers which operate several switches within a single housing. The dual plungers act independently of one another to provide switch redundancy if required. The plungers have rectangular surfaces with cams, and the switches have cam followers which operate the switches. In an alternative application, some of the switches may be replaced with a printed circuit board and a plunger with multi-finger wiping contacts. The printed circuit board and plunger with multi-finger wiping contacts arrangement allows the switch to produce a signal that is related to the distance of pedal movement. Additionally, a capacitor is provided on the housing for the purposes of filtering any electrical signal produced by electrical contact arching in a switch used in a high voltage circuit. The capacitor is held in the switch assembly by a box and a holding clip. The capacitor's placement in the switching circuit is such that it is in parallel with the switch.

23 Claims, 11 Drawing Sheets

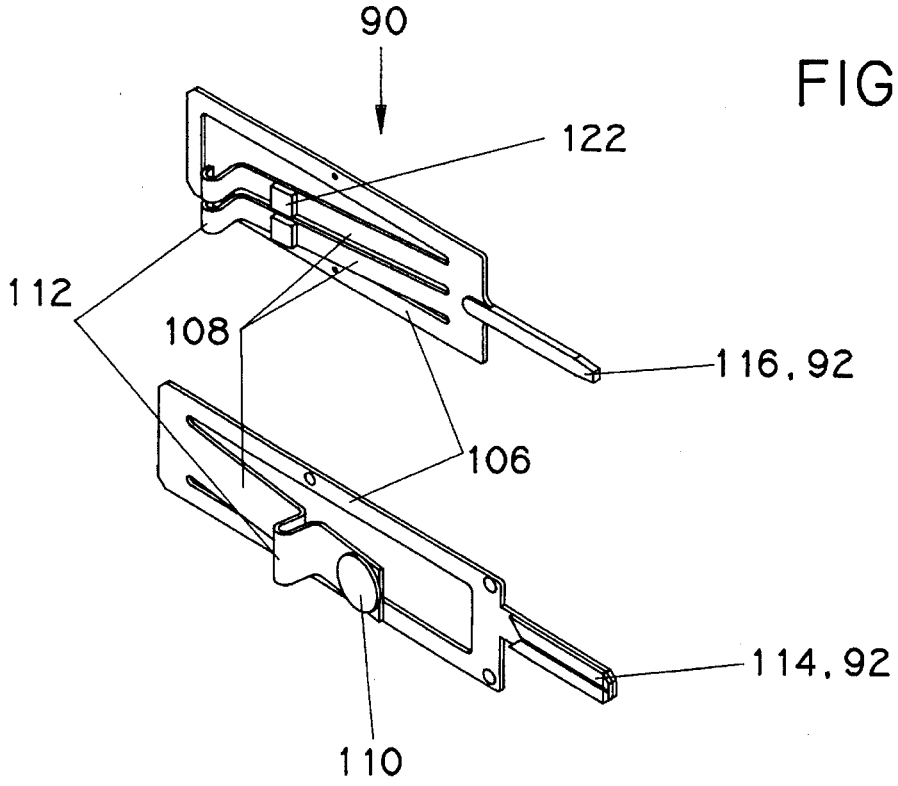
FIG. 6
FIG. 7
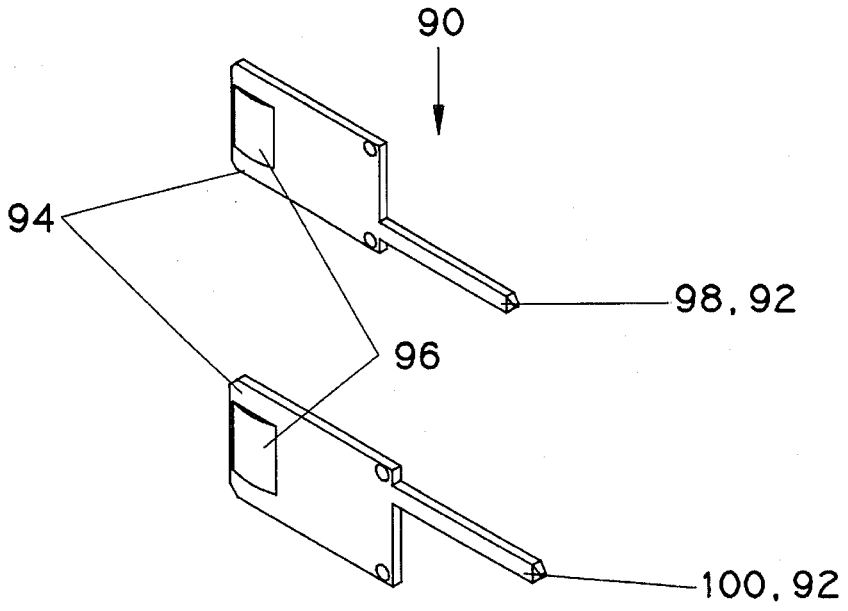

MULTIPLE PLUNGER PEDAL SWITCH ASSEMBLY

BACKGROUND

This invention relates to a device for making and breaking circuits in automotive switch assemblies where the switch operation involves actuation by a foot pedal which moves a cam to impart motion to a contact which opens or closes an electrical circuit. Automotive brake pedal actuated switch assemblies are widely used to control a variety of automotive functions when a brake pedal is depressed such as: energizing brake lights, deactivating a cruise control, signaling an anti-lock brake system, signaling a torque converter clutch, and signaling a brake/transmission shift interlock.

While many automobile functions depend upon the use of brake pedal actuated switches, most pedal switch assemblies contain only a few switches. Because of this, many automobiles require more than one switch assembly to perform all of the necessary brake related functions. Automobiles with more than two or three brake related applications generally require two or more switch assemblies. Furthermore, some automobiles provide more than one switch assembly to supply a redundant switch in case one of the switch assemblies becomes jammed or is inoperative for some reason. In this case, the second switch assembly will relay the necessary signal to the particular brake related function when the first switch assembly fails. This redundancy is especially desirable with safety features such as a cruise control release which deactivates an automobile's cruise control upon depression of the brake pedal.

While two or more switch assemblies may relieve the concerns for redundancy and an ample number of switches, numerous switching assemblies create problems in s terms of spatial concerns, extra vehical weight, increased costs of labor, and increased costs of material. Spatial concerns arise when more than one pedal switch assembly must contact the brake pedal because there is often a problem in finding a way to fit the housings against the brake pedal. Vehical weight increases with the extra switch assemblies and their mounting means, and this is a concern to automobile manufacturers. Material costs for the extra assemblies and their necessary wiring place an additional burden on total vehical cost. Also, extra installation time causes labor costs to increase with each extra assembly.

In modern automobiles, electronic controls are becoming more prevalent. For this reason there is a need to generate a signal from the brake pedal that is related to the distance of pedal movement. This analog signal can then be transferred to an on-board computer to control braking functions depending upon the magnitude of the signal that is received from the brake pedal. Most of today's pedal switch assemblies only use simple single pole, single throw switches to turn braking devises on or off depending upon whether the pedal has been engaged to a certain extent. Because these switch assemblies are mainly limited to single pole single throw switches, their usefulness on modern automobiles with on board computers is limited. Versatile switch assemblies are needed today because some automobiles are moving toward braking systems that are mainly controlled by electronics, while other automobiles continue to use braking systems that are more mechanically controlled.

Another problem in pedal switch technology is that arcing during contact making and breaking in high voltage switching circuits can cause arcing noise which interferes with the automobile's audio system. To minimize the interference, a capacitor is sometimes used in the circuit to filter the effects of any electrical signal that is generated by arcing across contacts. In some previous applications, a capacitor has been connected in parallel to terminals which mate with the terminals of the brake switch assembly. In such an arrangement, the capacitor is connected to the pedal switch entirely aside from the switching assembly. The addition of a capacitor outside of the switching assembly causes increased costs by way of labor, time, and connection materials. To reduce these costs, there is a need for a capacitor that acts as an electrical filtering capacitor and is connected to the pedal switch assembly itself. This would mean that once the pedal switch assembly is installed, other installation steps would not be required to place a filtering capacitor on the pedal switch.

SUMMARY

Accordingly, it is an object of the invention to provide multiple switches in a single housing. Another object of the invention is to allow for redundant switching operation in a single housing. A further objective of the invention is to provide a signal that is related to the distance of pedal movement for processing by an on-board computer. Another objective of the invention is to provide an electrical filter on the housing that does not require additional installation steps once the switch assembly is put into place.

The multiple plunger pedal switch assembly of the present invention comprises a switch carrier, a housing, a housing cover, at least two switches, and at least two spring biased plungers. The housing rides in the switch carrier, and the switch carrier is used to mount the whole assembly to a stationary surface adjacent to the brake pedal. The housing also encloses the switches which activate electrical devices. These switches are operated by plungers, each plunger having cams and a shaft. The cams selectively engage the switches for switch operation when the shafts are released or depressed by operation of the brake pedal.

In an alternative arrangement, the multiple plunger pedal switch assembly substitutes a spring biased plunger having electrical contacts for one of the plungers having cams. Also, a printed circuit board is substituted for at least one of the switches. In this arrangement, the attached contacts slide along the printed circuit board as the plunger shaft is released by engagement of the brake pedal to produce a voltage across two terminals that is related to the distance of pedal movement.

The multiple plunger pedal switch assembly not only comprises a switch carrier, a housing, switches, and plungers, but it also comprises a capacitor carried by the housing which acts to filter the effects of arcing in at least one of the switches.

BRIEF DESCRIPTION OF THE DRAWINGS

These and other features, aspects, and advantages of the present invention will become better understood with regard to the following description, appended claims, and accompanying drawings where:

FIG. 6 shows an enlarged view of two spring blades;

FIG. 7 shows an enlarged view of two stationary blades;

DETAILED DESCRIPTION

The multiple plunger pedal switch assembly 20 is designed for use with modern automobile braking functions. The invention is versatile because it can be built with different components depending upon the braking function to be used in conjunction with the switch assembly. A first application of the invention includes single pole single throw switches that are either opened or closed to operate an electrical devise. The switches in the first application are operated by means of cam followers and plungers. A second application of the invention includes replacing some of the switches in the first application with a printed circuit board that produces an analog signal related to the distance of pedal movement. In many modern automobile applications, this analog signal may be used in conjunction with an on board computer to perform a desired braking function.

Figure 1:
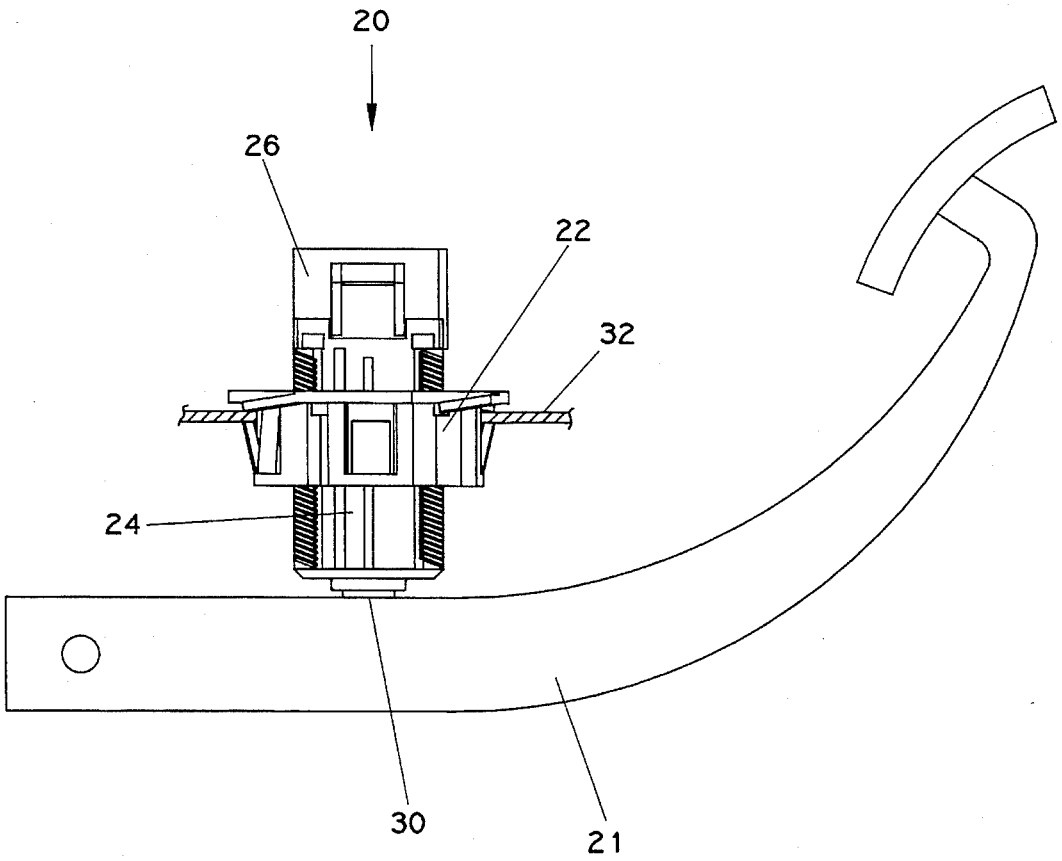
FIG. 1 shows the invention installed against the brake pedal.
Figure 2:
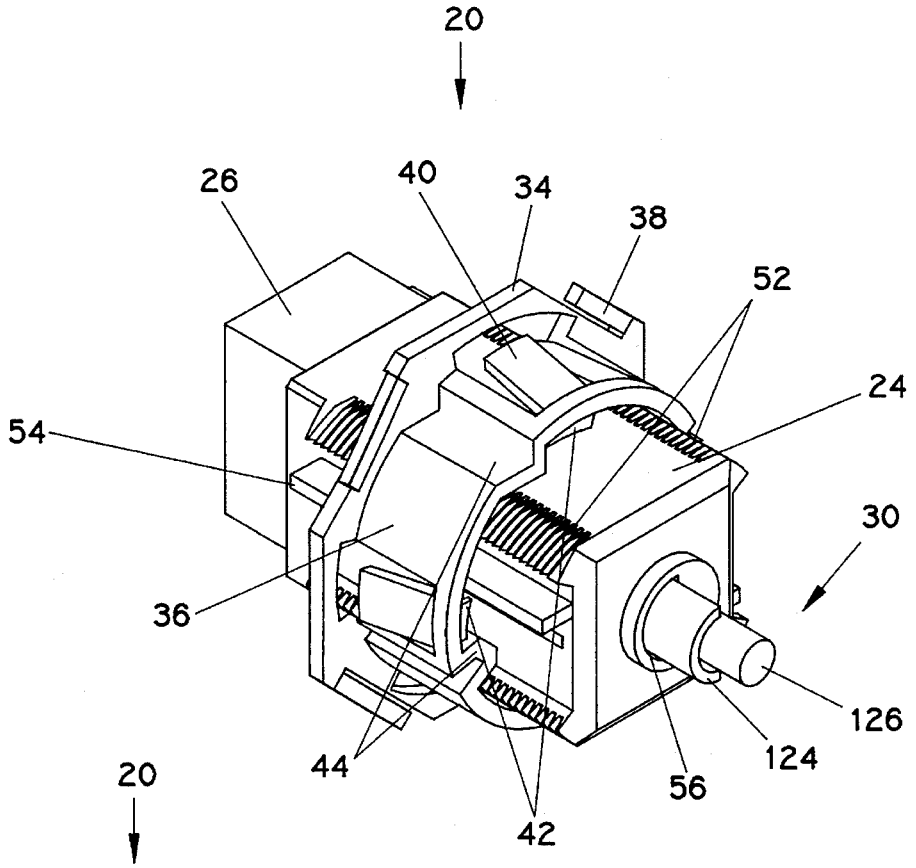
FIG. 2 shows another view of the invention in a switch carrier.
Figure 3:
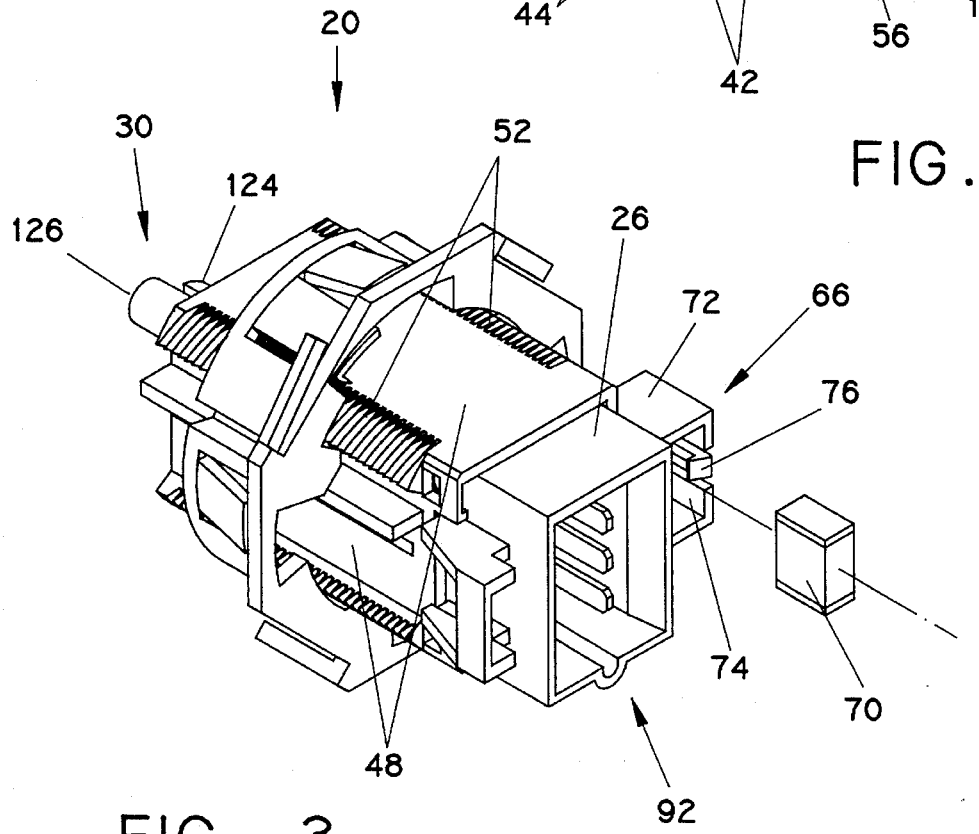
FIG. 3 shows a view of the invention with a capacitor.

FIG. 1 displays a multiple plunger pedal switch assembly 20 installed against a brake pedal 21. Under the first application, the multiple plunger brake switch assembly includes a switch carrier 22, a housing 24, a housing cover 26, switches, and plungers 30.

Referring to FIGS. 2 through 5, the switch carrier 22 engages the housing 24 to mount the multiple plunger pedal switch assembly to a stationary surface 32. The switch carrier 22 is an acetal material and includes a carrier base 34 and a hollow cylindrical sleeve 36. The carrier base 34 is octagonal in shape and has spring arms 38 to assist in securing the switch carrier 22 to a stationary surface 32. The hollow cylindrical sleeve 36 is designed to fit into an opening in a stationary surface. Installation clips 40 protrude from the hollow cylindrical sleeve 36 and serve to trap the switch carrier 22 into place against the stationary surface 32 when the sleeve is pushed through the opening. Threading tabs 42 and retention grooves 44 are formed on the cylindrical sleeve 36 and interact with the housing 24 to position the housing in the switch carrier 22. Locking clips are also located in the hollow cylindrical sleeve 36 to secure the housing 24 in the switch carrier 22.

The housing 24 is manufactured from a glass/mineral filled nylon material and comprises four sidewalls 48, a housing cavity 50, threaded edge ribs 52, retention ribs 54, a plunger opening 56, mounting channels 58, and an open end 60. The four sidewalls 48 of the housing are quadrilateral in shape and intersect to form the housing cavity 50. Threaded edge ribs 52 extending parallel along the intersection of each sidewall 48, and these threaded edge ribs 52 serve to properly position the housing 24 in the switch carrier 22 by meshing with the threading tabs 42 when the housing is rotated in the switch carrier. Upon meshing with the threading tabs 42, the threaded edge ribs 52 meet the retention grooves 44 and prevent the housing from rotating too far in the switch carrier 22. Two opposing sidewalls 48 have retention ribs 54 extending the length of the sidewall. When the housing 24 is rotated in the switch carrier 22 the retention ribs 54 slide past the locking clips to snap the housing into its proper place in the switch carrier. The locking clips also prevent the housing 24 from rotating backwards once the housing is properly positioned.

The plunger opening 56 is located on the housing 24 such that it faces a brake pedal 21. When the plungers 30 are mounted within the housing 24, a portion of each plunger extends from the plunger opening 56 and contacts the brake pedal 21. Mounting channels 58 are formed on the interior of the housing 24 to properly fix the switches and plungers 30 within the housing. The mounting channels 58 are about 0.072 inches (0.183 cm) wide for the plungers 30 and the printed circuit board 164, and about 0.040 inches (0.102 cm) wide for the switches. The open end of the housing 60 receives the switches and plungers for insertion into the mounting channels 58.

The housing cover 26 connects to the open end of the housing 60 and includes eight terminal sockets, two spring guides, and a capacitor box 66. The terminal sockets are equally spaced in two rows, and allow for switch communication from within the housing 24 to the outside of the housing cover 26. The spring guides extend from the housing cover 26, and springs 68 are placed over the spring guides for use in biasing the plungers 30. The springs 68 used for biasing the plungers 30 have a spring rate of 2.6 lbs per inch.

The capacitor box 66 is integral to the housing 24 and housing cover 26. The capacitor box 66 is located near the terminal sockets for use in holding a capacitor 70 for the purpose of providing an electrical interference filter to a high voltage switch in which some arcing occurs. The capacitor box 66 has walls 72, an entrance 74, a holding clip 76, and spring contacts 78. The walls of the capacitor box 72 form a cubical structure, and when the housing cover 26 is attached to the housing 24, the entrance of the capacitor box 74 faces away from the housing 24. One of the walls 72 has a holding clip 76 which is angled such that it allows a capacitor 70 to slide into the capacitor box 66 through the entrance 74, but it will not allow the capacitor to slide back out of the capacitor box. Spring contacts 78 are placed on two opposing walls of the capacitor box 72, and the spring contacts 78 make an electrical connection with the capacitor 70 upon the capacitor's insertion into the capacitor box 66. The spring contacts 78 are connected to one of the switches such that the capacitor 70 is in parallel with the switch. The capacitor 70 is a film capacitor that has a cubical structure with dimensions of 0.450 inches (1.143 cm) by 0.250 inches (0.635 cm) by 0.330 inches (0.838 cm). The capacitor 70 has a capacitance between 0.27 MFD and 0.39 MFD, and a voltage rating of 250 VDC.

To connect the capacitor 70 in parallel with the switch, the capacitor is simply placed into the capacitor box 66 through the entrance 74, and the spring contacts 78 touch against the capacitor to establish an electrical connection. This feature on the capacitor box 66 means that no soldering or other fastening is needed to place the s capacitor 70 in parallel with the switch, and a significant ease of assembly is passed on to the manufacturer of the pedal switch assembly. This ease of assembly means cost savings to the manufacturer of the pedal switch assembly in the form of labor and materials. Furthermore, an automobile producer who makes use of the switch assembly will realize time and money savings by having a capacitor to filter arcing noise already installed in the switch assembly so that the automobile producer does not have to install the capacitor apart from the pedal switch assembly.

Referring to FIGS. 5, 6, 7, and 18 switches are enclosed in housing 24 and retained by the mounting channels 58. The switches comprise a first switch 80, a second switch 82, a third switch 84, and a fourth switch 86. Each switch contains a stationary blade 88 and a spring blade 90. The stationary blades 88 are manufactured from a silver-plated 260 alloy brass, and each stationary blade comprises a terminal 92, a blade plane 94, and at least one contact dimple 96. The terminals 92 for the stationary blades 88 include a B terminal 98 for the first switch 80, a C terminal 100 for the second switch 82, an F terminal 102 for the third switch 84, and a G terminal 104 for the fourth switch 86. Each blade plane 94 is rectangular in shape with at least one contact dimple 96 formed on the blade plane and a terminal 92 extending from a corner. Each stationary blade 88 is placed in the housing 24 by sliding the blade plane 94 into the appropriate mounting channel 58 through the open end of the housing 60. When a stationary blade 88 is inserted in the housing, its terminal 92 will extend from the open end of the housing 60.

The first switch 80 has a spring blade 90 that is manufactured from a 510 phosphor bronze, and it is designed for use in a circuit with a higher current (up to 21 amps) than the second, third, and fourth switches (each respectively operating at a steady state between 0.014 and 1.5 amps). The spring blade 90 of the first switch comprises a blade base 106, a terminal 92, a cantilever arm 108, an electrical contact 110 made of a silver-copper-nickle material, and a cam follower 112. The blade base 106 forms a shape similar to the perimeter of a rectangle and surrounds the cantilever arm 108. The terminal 92 extends out from the perimeter of the blade base 106, and this terminal for the spring blade 90 of the first switch 80 is labeled an A terminal 114. The cantilever arm 108 extends from the blade base 106 and the silver-copper-nickel electrical contact 110 is riveted on to the cantilever arm 108 such that it will make with the contact dimple 96 on the first switch's stationary blade 88. At an appropriate place on the cantilever arm 108, a bend in the 510 phosphor bronze creates a cam follower 112. The cam follower 112 slideably interacts with a plunger 30 to operate the switch. The spring blade 90 is placed in the housing 24 by sliding the blade base 106 into the appropriate mounting channel 58 through the open end of the housing 60. When the spring blade 90 is inserted in the housing 24, the terminal 92 will extend from the open end of the housing 60. Together, the A terminal 114 and the B terminal 98 make up leads to the first switch 80. The A and B terminals also contact the spring contacts 78 on the capacitor box, and, thus, an electrical filter is provided to screen arcing noise that occurs across the first switch 80 because of its use in higher voltage circuits.

The second 82, third 84, and fourth 86 switches also have spring blades 90 that are manufactured from a 510 phosphor bronze. Each of these spring blades 90 includes s a blade base 106, a terminal 92, two cantilever arms 108, electrical contacts 122, and cam followers 112. The blade base 106 forms a shape similar to the perimeter of a rectangle and surrounds the cantilever arms 108. The terminal 92 extends out from the perimeter of the blade base 106. The terminals for the spring blades include a D terminal 116 for the second switch 82, an E terminal 118 for the third switch 84, and an terminal 120 for the fourth switch 86. The two cantilever arms 108 extend from blade base parallel to one another, and a silver-nickel alloy electrical contact 122 is welded on to each cantilever arm 108. At an appropriate place on the two cantilever arms 108, a bend in the 510 phosphor bronze creates cam followers 112. The cam followers 112 slideably interact with the plungers 30 to operate the switches. The spring blade 90 is placed in the housing 24 by sliding the blade base 106 into the appropriate mounting channel 58 through the open end of the housing 60. When the blade base 106 is inserted in the housing 24, the terminal 92 will extend from the open end of the housing 60. Since the second 82, third 84, and fourth 86 switches have two cantilever arms 108, the probability of switch failure is reduced. The two cantilever arms 108 produce a bifurcated circuit so that if a contact 122 on either cantilever arm fails to transfer an adequate electrical signal, the contact on the other cantilever arm serves as a backup for appropriate signal transmission.

Now referring to FIGS. 5, 8*a*, 8*b*, and 19, the plungers 30 comprise a first plunger 124 and a second plunger 126, and these two plungers are slideably carried in the housing 24 by the mounting channels 58. The first plunger 124 includes a rectangular surface 128, a crescent shaft 130, a spring cavity 132, cams 134, plunger guides 136, and plunger bearings 138. The rectangular surface 128 is 0.945 inches (2.40 cm) in length and includes a front edge 140, a back edge 142, and sides 144. The crescent shaft 130 is connected from the front edge 140 to the back edge 142 of the rectangular surface and extends 0.404 inches (1.026 cm) beyond the front edge of the rectangular surface. The cross-section of the crescent shaft 130 is in the shape of a semi-circle. Cams 134 are located on the rectangular surface 128 in a strategic fashion such that the cams selectively engage the switches for switch operation when the shaft 130 is released or depressed by operation of the brake pedal 21.

The cams on the first plunger 124 include a first cam 146 and a second cam 148. The first cam 146 begins to activate the first switch 80 when the first plunger 124 has moved about 0.130 inches (0.330 cm) within the housing. The first cam 146 is located toward the front edge 140 of the rectangular surface on one side 144, and faces the back edge 142. The first cam 146 is "S" shaped and slopes up from the rectangular surface 128 with a radius of 0.030 inches (0.076 cm). At the point where the radius reaches a tangent position relative to the perpendicular of the rectangular surface the cam 146 slopes back out with a radius of 0.050 inches (0.127 cm) until it is parallel to the rectangular surface 128. The first cam 146 raises 0.080 inches (0.203 cm) above the rectangular surface 128.

The second cam 148 begins to activate the second switch 82 when the first plunger 124 has moved about 0.173 inches (0.440 cm) within the housing. The second cam 148 is juxtaposed to the first cam 146 on the rectangular surface 128 and is positioned toward the back edge 142. The second cam 148 is ramp shaped and faces the front edge 140 of the rectangular surface. The second cam 148 is sloped at a 45 degree angle from the rectangular surface 128, and the cam raises to 0.080 inches (0.203 cm) above the rectangular surface.

The spring cavity 132 for the first plunger 124 is created by a hole formed in the second cam 148. The spring cavity 132 is visible from the back edge of the rectangular surface 142. A spring is placed into the spring cavity 132 to bias plunger movement. Plunger guides 136 are attached to the sides of the rectangular surface 144 and extend from the front edge 140 to the back edge 142, making them 0.945 inches (2.40 cm) in length. These plunger guides 136 are 0.050 inches (0.127 cm) in height and are designed to fit into the mounting channels 58 of the housing in order to direct plunger movement as the plunger slides in the housing 24. Plunger bearings 138 are located on the plunger guides 136 to stabilize plunger movement and reduce friction as the plunger slides in the mounting channels 58. The plunger bearings 138 are small tabs radiused to 0.020 inches (0.051 cm) and extending 0.010 inches (0.025 cm) beyond the height plunger guides 136. Two plunger bearings 138 are located on each plunger guide 136, one found toward the front edge of the rectangular surface 140, and another found toward the back edge 142. The first plunger 124 is placed in the housing 24 by sliding the plunger guides 136 into the appropriate mounting channels 58 through the open end of the housing.

The second plunger 126 includes a rectangular surface 128, a post shaft 150, a spring cavity 132, cams 134, plunger guides 136, and plunger bearings 138. The s rectangular surface 128 of the second plunger 126 is 0.802 inches (2.032 cm) in length and includes a front edge 140, a back edge 142, and sides 144. The post shaft 150 is connected from the front edge 140 to the back edge of the rectangular surface 142 and extends 0.614 inches (1.560 cm) beyond the front edge of the rectangular surface 140. The post shaft 150 is cylindrical in shape with an open end 152 and a closed end 154, the open end located toward the back edge 142 of the rectangular surface. The open end of the post shaft 152 reveals the spring cavity 132 which extends to the closed end of the shaft 154. A spring is placed into the spring cavity 132 to bias plunger movement.

Cams 134 are located on the rectangular surface 128 of the second plunger 126 in a strategic fashion such that the cams selectively engage the switches for switch operation when the post shaft 150 is released or depressed by operation of the brake pedal 21. The cams 134 on the second plunger 126 are ramp shaped and include a third cam 156 and a fourth cam 158. The third cam 156 begins to activate the third switch 84 when the plunger 126 has moved about 0.130 (0.330 cm), and the fourth cam 158 begins to activate by the fourth switch 86 when the plunger 126 has moved about 0.278 inches (0.705 cm). The third 156 and fourth cam 158 are both sloped at 45 degrees from the rectangular surface 128, and raise to 0.096 inches (0.244 cm) above the rectangular surface. These two cams are located on opposite sides of the rectangular surface 128, and both cams face the front edge 140.

Plunger guides 136 are attached to the sides of the rectangular surface 144 of the second plunger 126 and extend from the front edge 140 to the back edge 142, making them 0.805 inches (2.045 cm) in length. The plunger guides 136 are 0.050 inches (0.127 cm) in height and are designed to fit into the mounting channels 58 of the housing in order to direct plunger movement as the plunger slides in the housing 24. Plunger bearings 138 are located on the plunger guides 136 to stabilize plunger movement, compensate for manufacturing variations in the plunger guides, and reduce friction as the plunger slides in the mounting channels 58. The plunger bearings 138 are small tabs radiused to 0.020 inches (0.051 cm) and extending 0.010 inches (0.025 cm) beyond the height of the plunger guides 136. Two plunger bearings 138 are located on each plunger guide 136, one found toward the front edge of the rectangular surface 140, and another found toward the back edge 142. The second plunger 126 is placed in the housing 24 by sliding the plunger guides 136 into the appropriate mounting channels 58 through the open end of the housing 60.

When both plungers 30 are inserted into the housing 24, the shafts will fit into the plunger opening such that the crescent shaft 130 of the first plunger is concentric to the post shaft 150 from the second plunger. The plungers 30 are manufactured from a teflon filled sixty-six nylon to reduce friction as the plungers slide in the mounting channels 58. The first 124 and second plungers 126 both operate independently of one another with at least a 0.024 inch (0.062 cm) clearance separating the two plungers at all times. With independent operation of the plungers 30, if one plunger were to become jammed in the housing 24, the other plunger would continue to operate braking applications. This feature is useful for safety purposes because it can provide for electrical redundancy. If two switches that are respectively operated by different plungers 30 are tied into the s same circuit, redundancy allows one switch to act as a primary switch and another switch to act as a back-up switch. If one of the switches becomes inoperative because of plunger jamming or a similar reason, the other switch will still transfer the appropriate electrical signal to activate or deactivate the electrical device.

Figure 12:
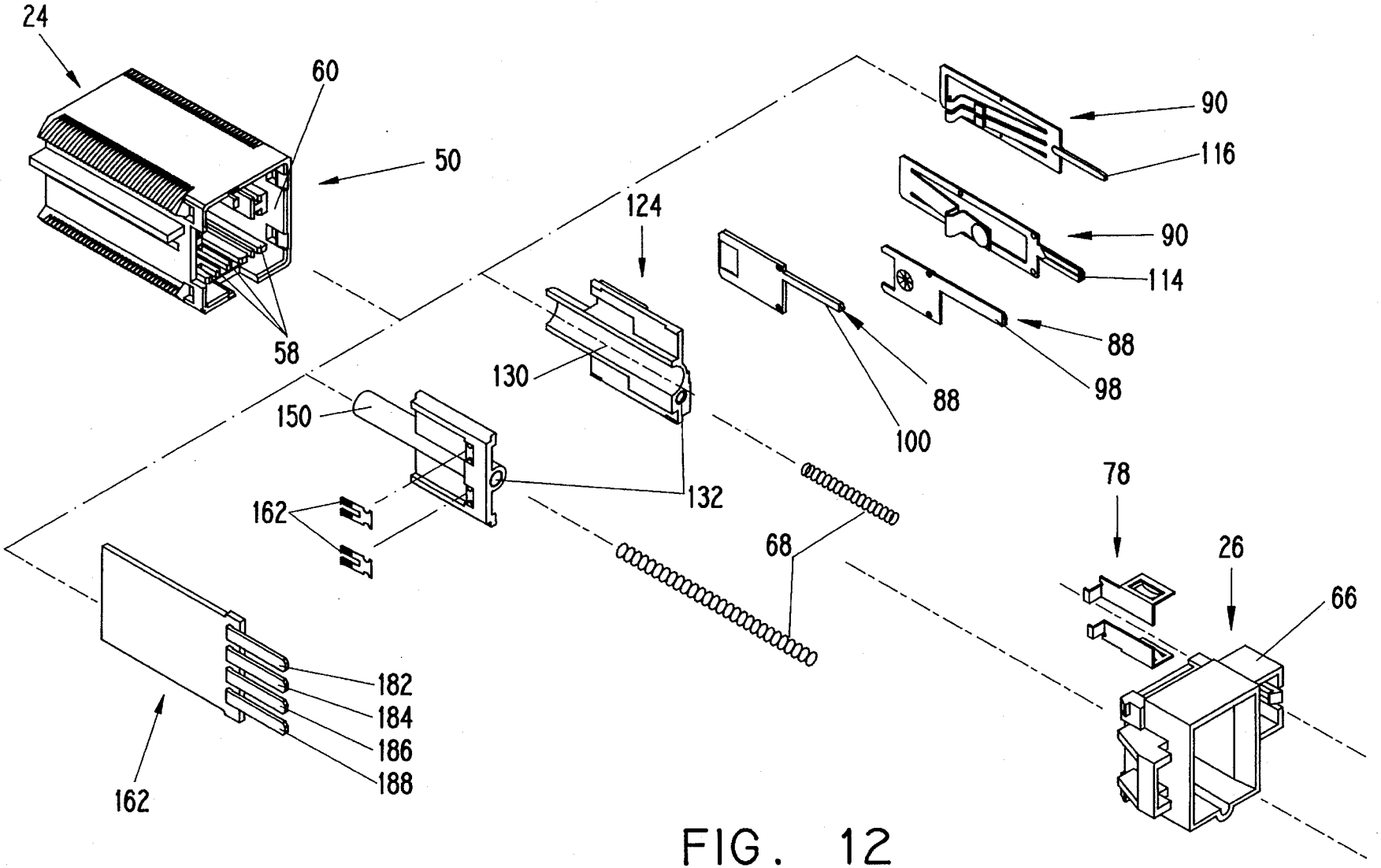
FIG. 12 shows piece parts of the invention that fit into a housing under a second application.
Figure 13:
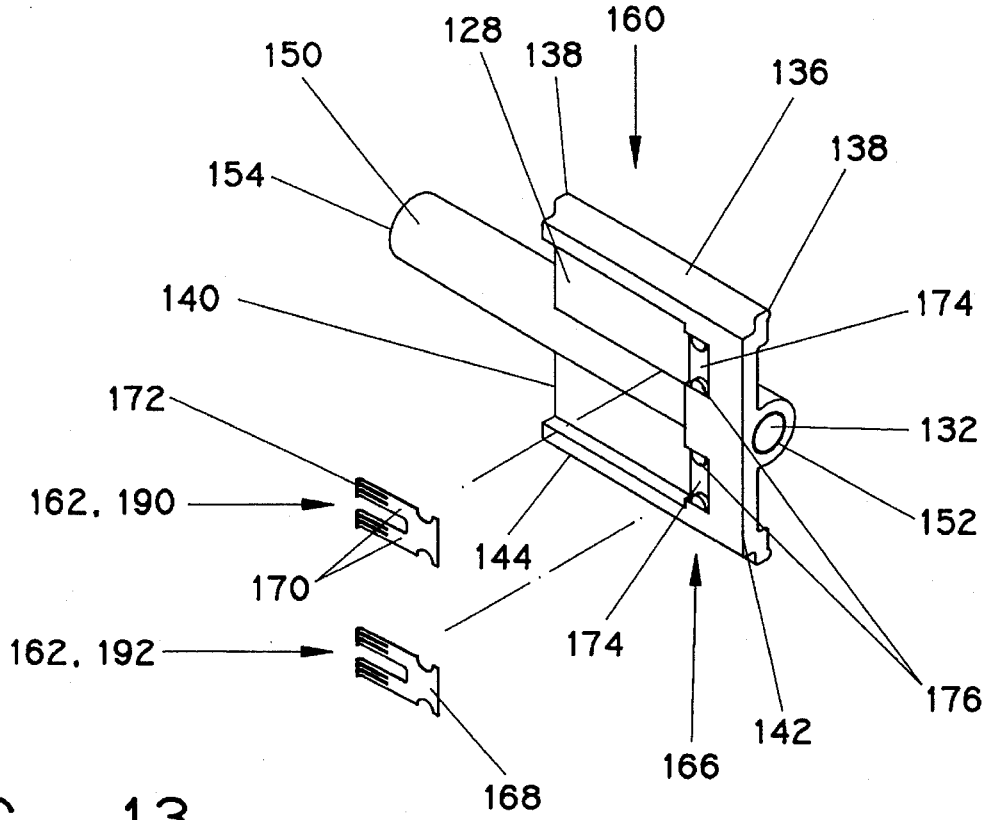
FIG. 13 shows an enlarged view of a third plunger and electrical contacts.
Figure 14:
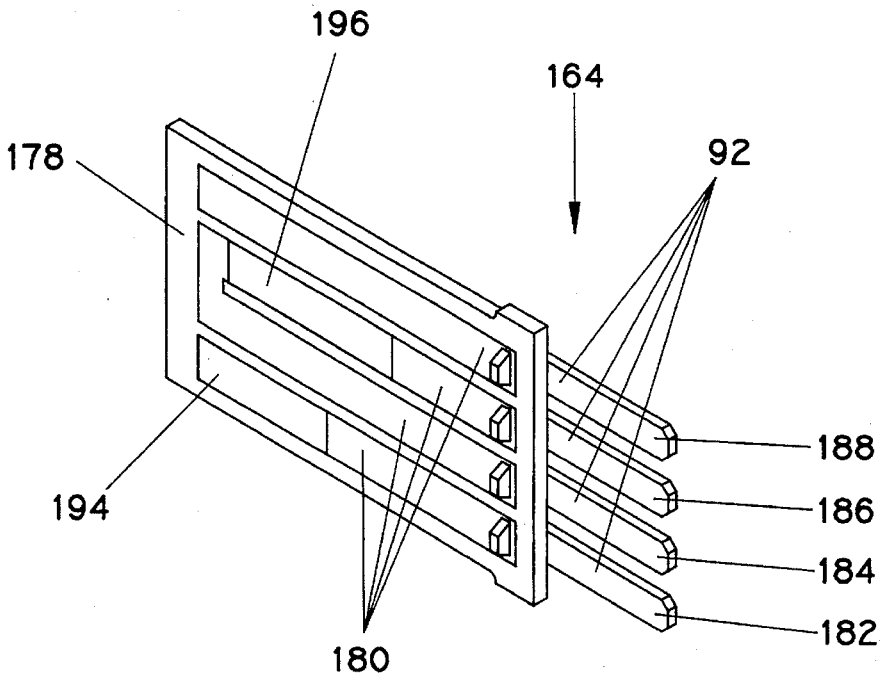
FIG. 14 shows an enlarged view of a printed circuit board.
Figure 15:
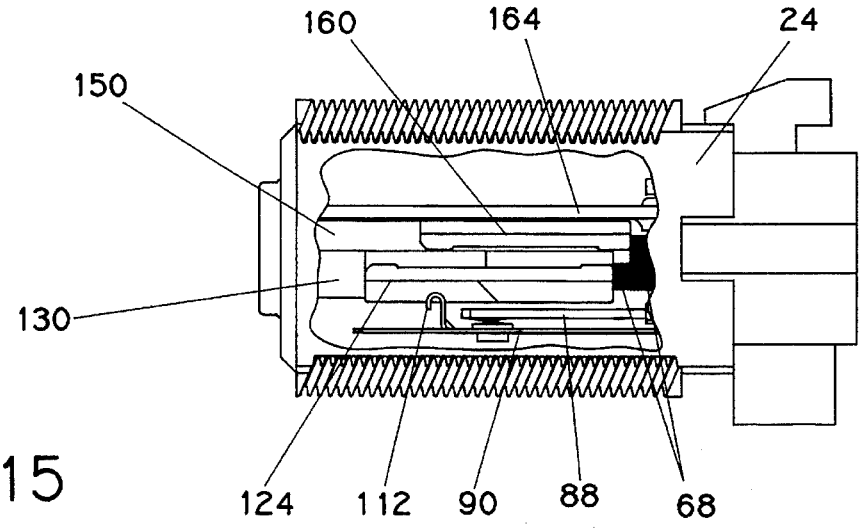
FIG. 15 shows a view of the invention inside of the housing when a brake pedal is not depressed by an operator's foot pressure under a second application.
Figure 16:
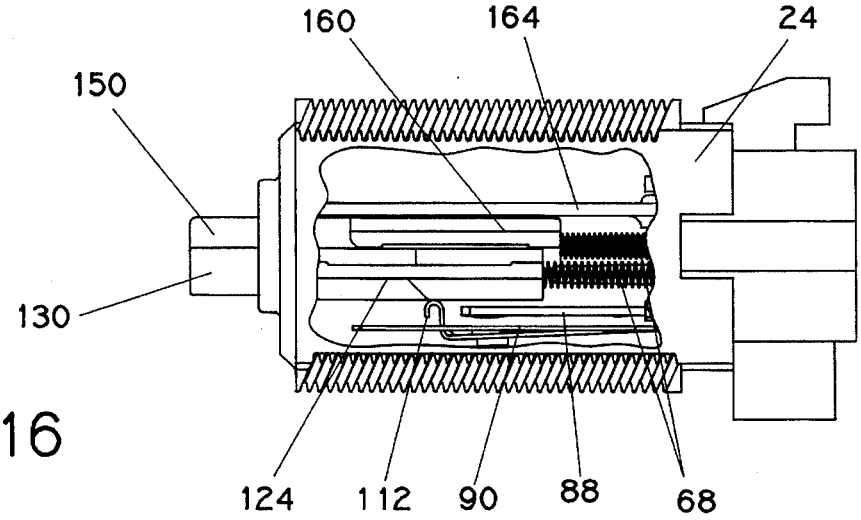
FIG. 16 shows a view of the invention inside of the housing when a brake pedal is partially depressed under a second application.
Figure 17:
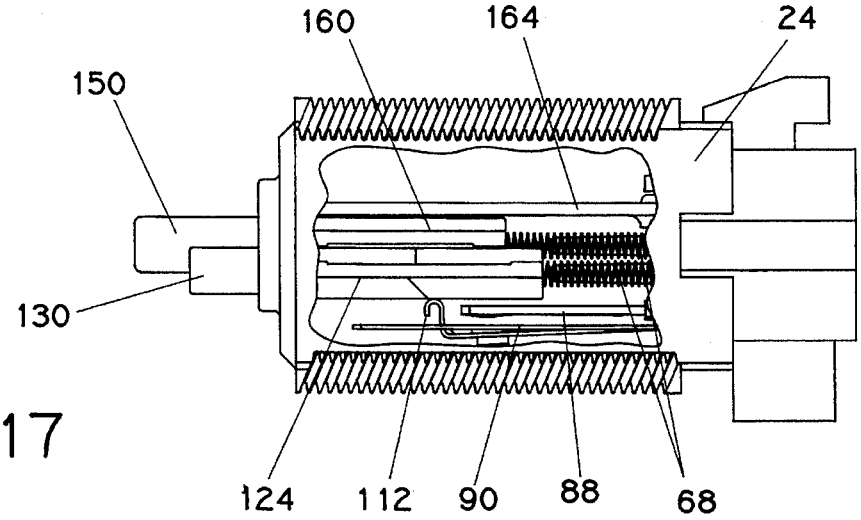
FIG. 17 shows a view of the invention inside of the housing when a brake pedal is substantially depressed under a second application.
Figure 18:
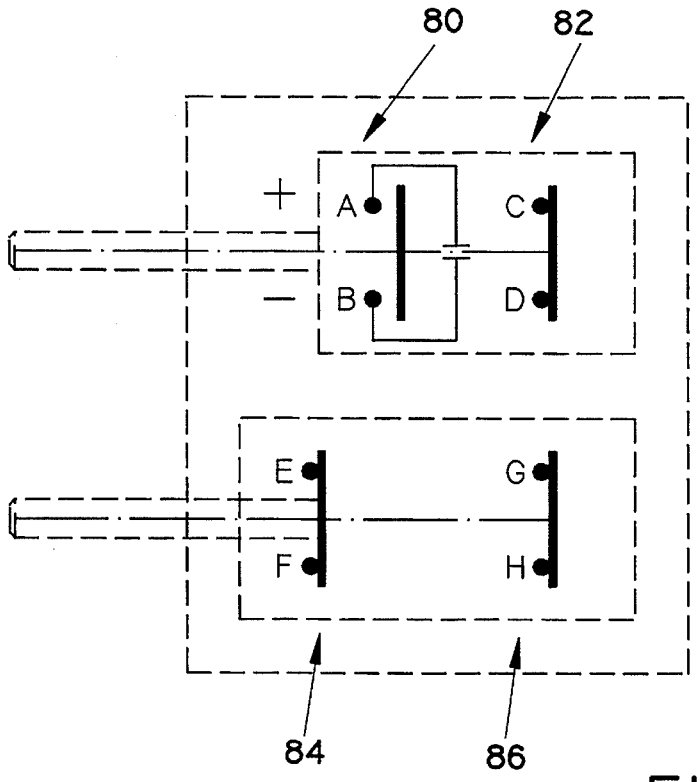
FIG. 18 shows a schematic of the invention under the first application.
Figure 19:
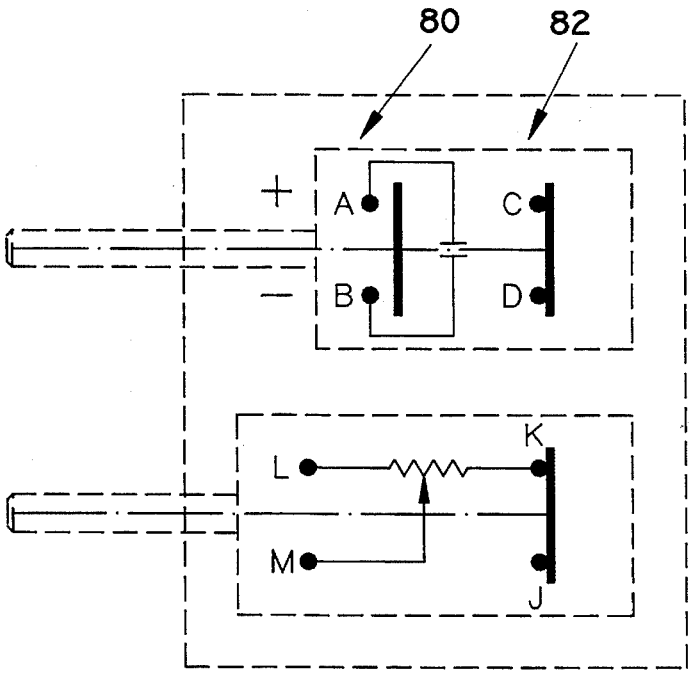
FIG. 19 shows a schematic of the invention under the second application.

The second application to the multiple plunger pedal switch assembly 20 is that it may be used to produce a signal related to the distance of pedal movement. Referring to FIGS. 12, 13, and 14, this arrangement is similar to the application described above in the first application, except, in the second application, the second spring biased plunger 126 is substituted for a third spring biased plunger 160 having electrical contacts 162, and the third 84 and fourth switches 86 are replaced with a printed circuit board 164.

The third plunger 160 includes a rectangular surface 128, a post shaft 150, a spring cavity 132, multi-finger wiping contacts 162, contact retainers 166, plunger guides 136, and plunger bearings 138. The rectangular surface 128 is 0.802 inches (2.037 cm) in length and includes a front edge 140, a back edge 142, and sides 144. The post shaft 150 is connected from the front edge 140 to the back edge of the rectangular surface 142 and extends 0.614 inches (1.560 cm) beyond the front edge of the rectangular surface. The post shaft 150 is cylindrical in shape with an open end 152 and a closed end 154, the open end located toward the back edge of the rectangular surface 142. The open end of the post shaft 152 reveals the spring cavity 132 which extends to the closed end of the shaft 154.

Multi-finger wiping contacts 162 are electrical contacts that are located on the rectangular surface 128 of the plunger 160, allowing the contacts to slideably engage the printed circuit board 164 when the plunger moves in the housing 24. Movement of the multiple finger wiping contacts 162 along the printed circuit board 164 serves to vary resistance in an electrical circuit to which the printed circuit board is integral. Plunger 160 and contact 162 movement along the printed circuit board 164 can relay a signal relative to the distance of pedal movement. The multi-finger wiping contacts 164 are made of a 752 nickel-silver alloy and include a base 168, arms 170, and fingers 172. Extending from the base 168 of the multi-finger wiping contacts 162, and parallel to each other, are two arms 170 with three fingers 172 on each arm. Each finger 172 is curved on an end so that the finger is forced against the printed circuit board 164 to provide contact redundancy and allow for adequate signal transmission. The base 168 holds the multi-finger wiping contacts 162 in place on the plunger 160 by fitting snugly against the contact retainers 166 which are located near the back edge of the rectangular surface 142. The contact retainers 166 include installation slots 174 and circular base holders 176. The installation slots 174 allow the base of the multi-finger wiping contact 168 to fit into the contact retainer 166, while the circular base holders 176 are mechanically smashed to apply pressure to the sides of the base 168 to hold the multi-finger wiping contact 162 in the contact retainer 166.

Plunger guides 136 are attached to the sides of the rectangular surface 144 and extend from the front edge 140 to the back edge 142, making them 0.805 inches (2.045 cm) in length. The plunger guides 136 are 0.050 inches (0.127 cm) in height and are designed to fit into the mounting channels 58 of the housing in order to direct plunger movement as the plunger 160 slides in the housing 24. Plunger bearings 138 are located on the plunger guides 136 to stabilize plunger movement and reduce friction as the plunger 160 slides in the mounting channels 58. The plunger bearings 138 are small tabs radiused to 0.020 inches (0.051 cm) and extending 0.010 inches (0.025 cm) beyond the height of the plunger guides 136. Two plunger bearings 138 are located on each plunger guide 136, one is found toward the front edge of the rectangular surface 140, and another is found toward the back edge 142. The plunger 160 is placed in the housing 24 by sliding the plunger guides 136 into the appropriate mounting channels 58 through the open end of the housing 60.

The printed circuit board 164 includes a board 178, four terminals 92, and conductive inks 180. The board 178 is manufactured from a CEM-1 material, and the four terminals 92 are soldered to the board such that each terminal extends from the board parallel to the other terminals. The four terminals 92 include a J terminal 182, a K terminal 184, an L terminal 186, and an M terminal 188. When the printed circuit board 164 is placed in the housing 24, the multi-finger wiping contacts 162 of the third plunger 160 are pressed against the board 178. Plunger movement causes the multi-finger wiping contacts 162 to move along the conductive inks 180. A first multi-finger wiping contact 190 interacts with the printed circuit board 164 such that one arm 170 contacts conductive ink 180 attached to the J terminal 182, and the second arm contacts conductive ink attached to the K terminal 184. The two arms 170 move along conductive ink 180 paths connected to the J 182 and K 184 terminals and act as a closed switch until one arm hits a strip of non-conductive ink 194 connected to the J terminal 182 and the circuit is broken. Thus, the J 182 and K 184 terminals act as a switching device to either communicate a signal or behave as an open circuit.

A second multi-finger wiping contact 192 moves along the board 178 such that one arm contacts a resistive ink 196 connected to the L terminal 186, and another arm contacts conductive ink 180 attached to the M terminal 188. This scheme behaves as a potentiometer with the distance of plunger 160 travel adjusting the potentiometer. Since the distance of plunger 160 travel is proportional to the distance of brake pedal 21 travel, a signal is generated across the L 186 and M 188 terminals that is relative to the distance that the brake pedal 21 has traveled. While the potentiometer created in the multiple plunger pedal switch assembly is a substantially linear potentiometer, other applications may include a non-linear potentiometer.

Operation

Figure 4:
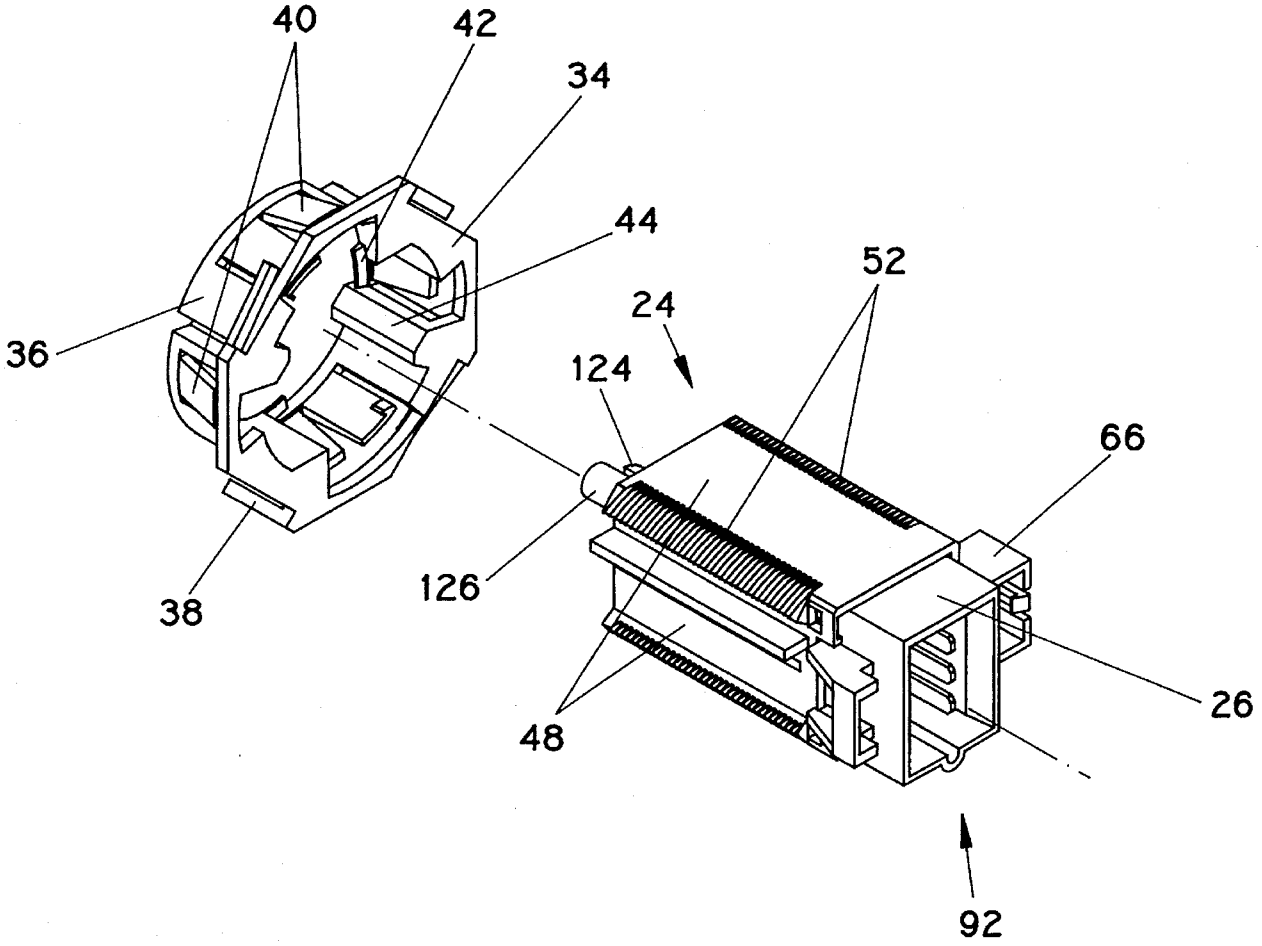
FIG. 4 shows how to fit the invention into a switch carrier.
Figure 5:
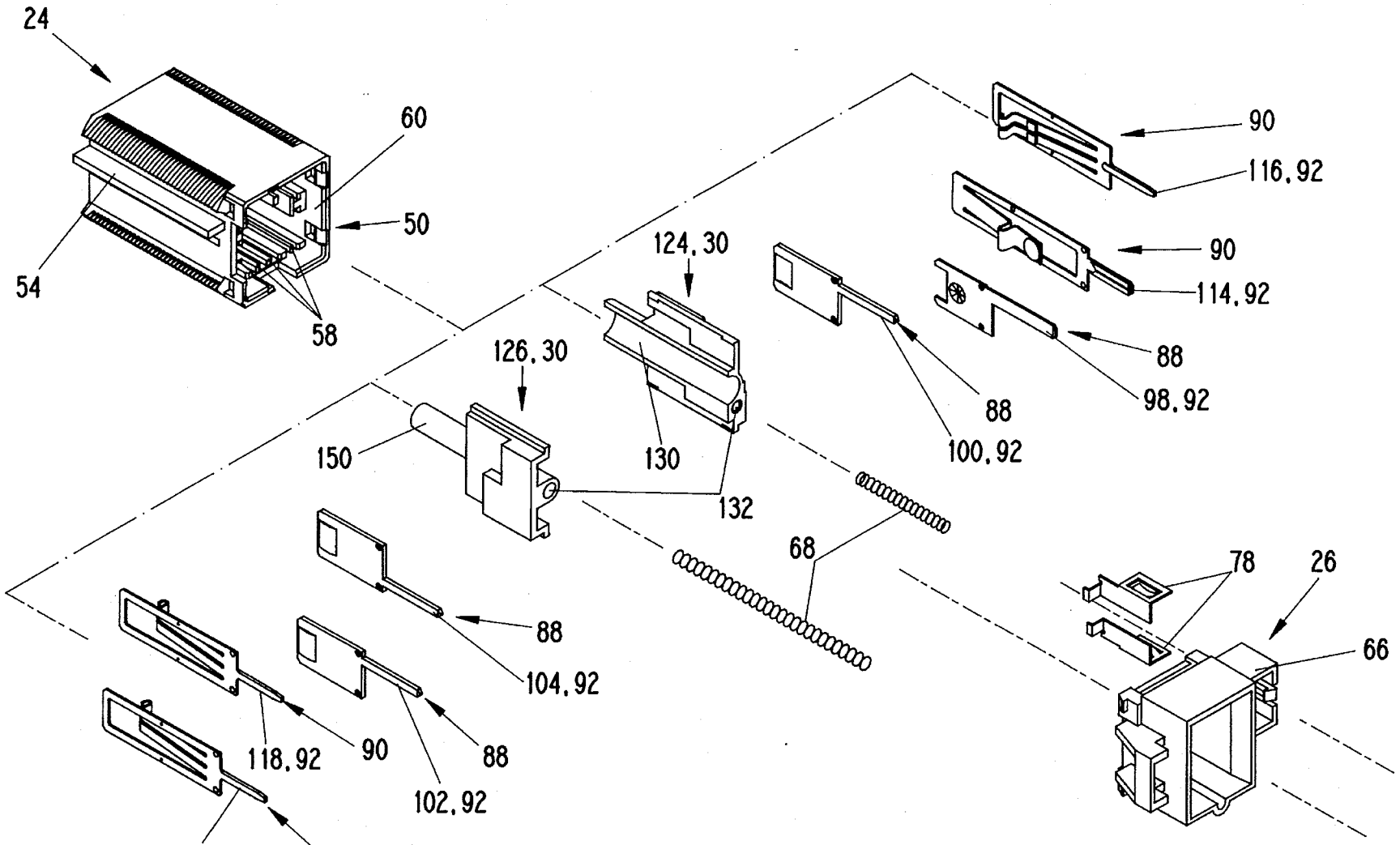
FIG. 5 shows piece parts of the invention that fit into a housing under a first application.
Figure 8A:
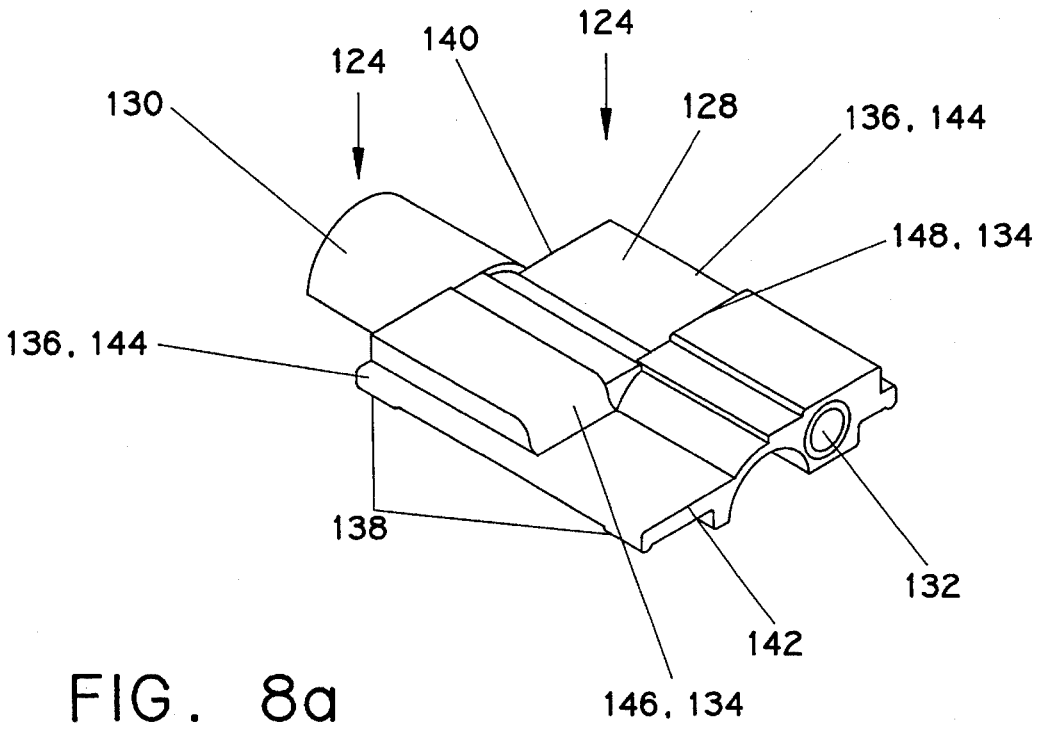
FIG. 8*a* shows a view of a first plunger that fits into the housing under the first application.
Figure 8B:
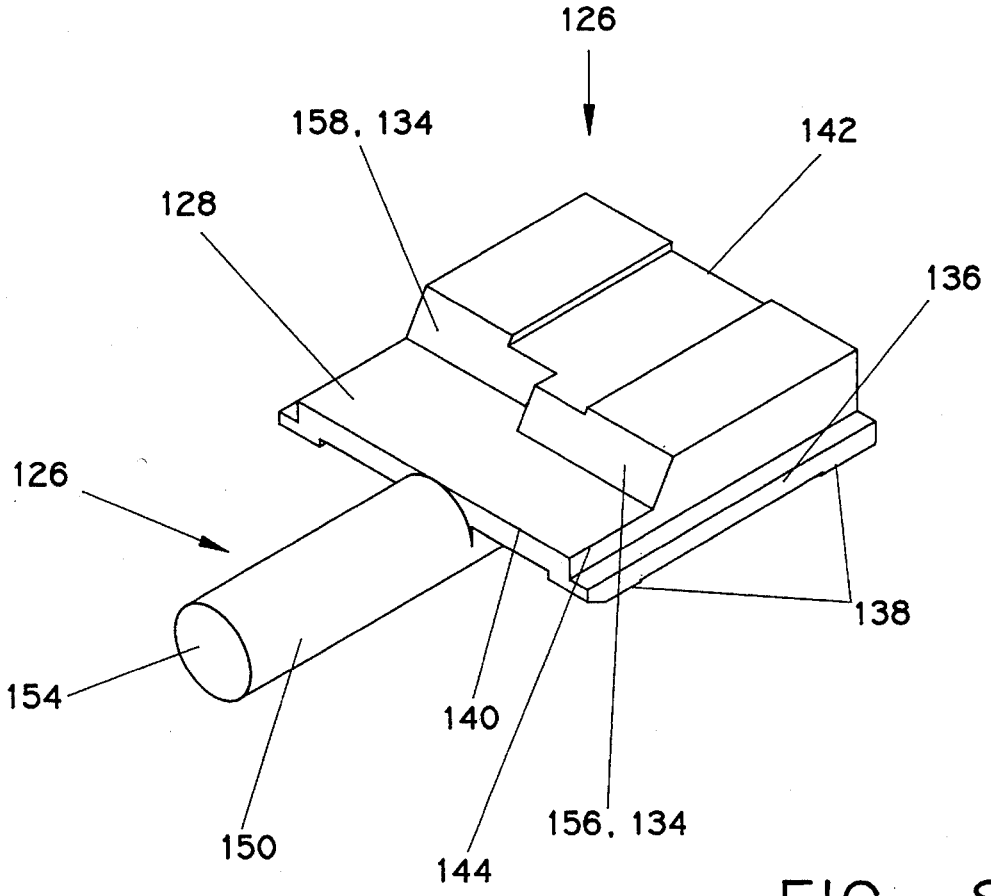
FIG. 8*b* shows a view of a second plunger that fits into the housing under the first application.
Figure 9:
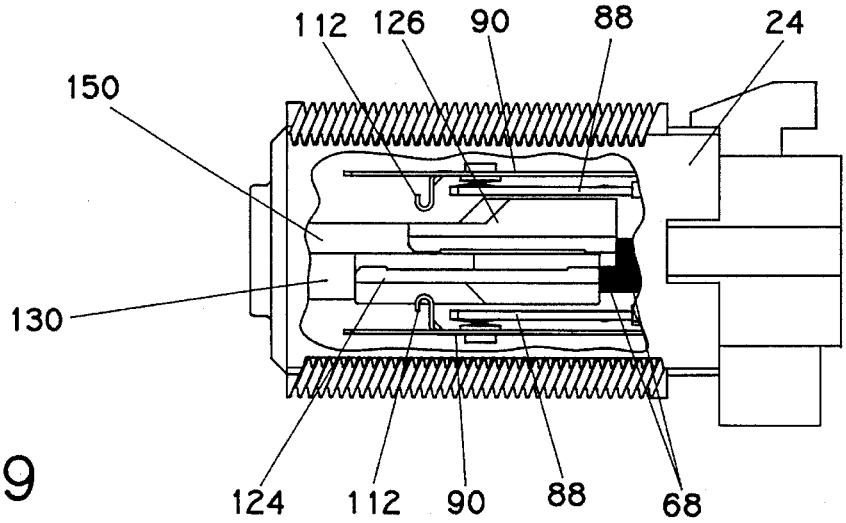
FIG. 9 shows a view of the invention inside of the housing when a brake pedal is not depressed by an operator's foot pressure under a first application.
Figure 10:
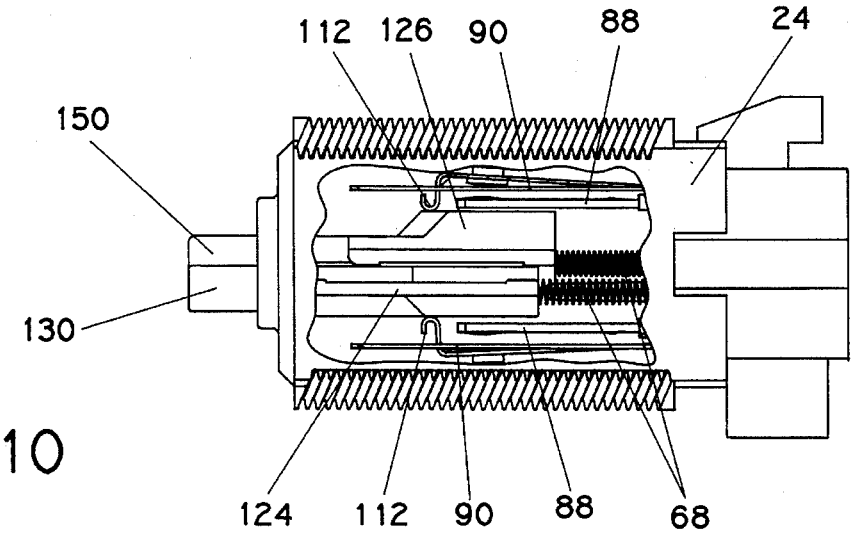
FIG. 10 shows a view of the invention inside of the housing when a brake pedal is partially depressed under a first application.
Figure 11:
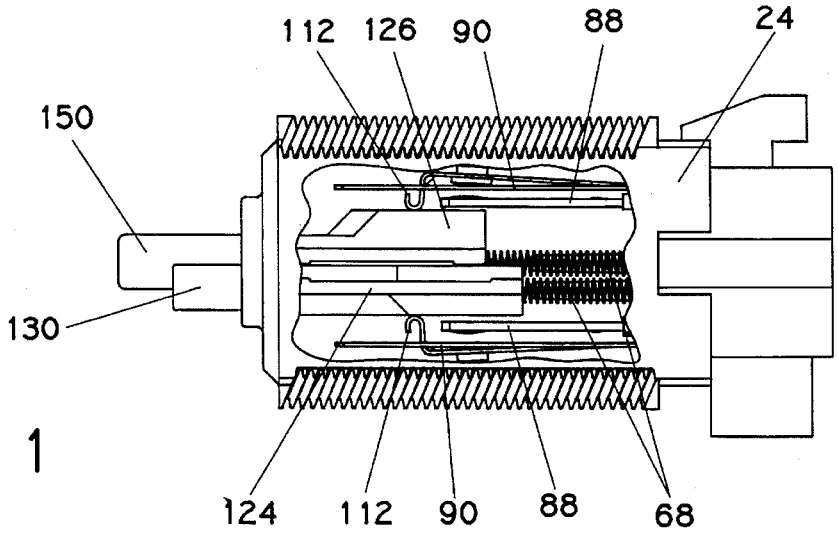
FIG. 11 shows a view of the invention inside of the housing when a brake pedal is substantially depressed under a first application.

Operation of the multiple plunger pedal switch assembly 20 under the first application is now described. Referring to FIGS. 1 and 4, with the switch carrier 22 installed against the stationary surface 32, the housing 24 is placed into the switch carrier with the plunger 30 shafts facing the brake pedal 21. When the plunger 30 shafts are substantially depressed into the housing because of the shafts pushing against the brake pedal 21 the housing 24 should be rotated in the switch carrier 22. Rotation of the housing 24 in the switch carrier 22 causes the threaded edge ribs 52 to mesh with the threading tabs 42 and properly position the housing in the switch carrier. As the housing 24 is rotated, the threading action draws the housing away from the brake pedal 21 by about 0.030 inches (0.075 cm), and, thus, the shafts 130 150 on the spring biased plungers 30 extend from the housing by this amount. The housing 24 is rotated to its proper place in the switch carrier 22 when the retention ribs 54 slide past the locking clips, and the threaded edge ribs 52 meet the retention grooves 44 of the switch carrier. The locking clips prevent the housing 24 from rotating backwards once the housing is properly positioned, and the retention grooves 44 prevent the housing from rotating too far in the switch carrier 22.

Referring to FIGS. 9, 10, 11, and 18, when the brake pedal 21 is in a disengaged position (no force applied to the pedal by an operator's foot) the shafts 130 150 are depressed into the housing because of pedal pressure against the shafts. Engagement of the brake pedal 21 (by the operator applying force to the pedal) moves the pedal away from the housing 24. As the pedal moves away from the housing, the spring biased plungers 30 are released as they follow the pedal's movement with the shafts 130 150. Plunger actuation causes the cams 134 on the plungers 30 to slide across the cam followers 112. When the cams 134 press against the cam followers 112, the cantilever arms 108 are forced away from the stationary blades 88. When the cams 134 are removed from the cam followers 112, the cantilever arms 108 spring back toward the stationary blades 88. As the cantilever arms 108 are moved, the contacts 110 122 on the cantilever arms either make or break connection with the contact dimples 96 on the stationary blades 88, opening or closing each respective switch depending upon the position of the cam follower 112 against the cam 134. Each switch is part of a circuit that activates or deactivates automobile devices such as brake lamps, a cruise control, an anti-lock braking system, a torque converter clutch, or a brake/transmission shift interlock.

In the disengaged position, the first switch 80 is open, and the second 82, third 84, and fourth 86 switches are closed. After the brake pedal 21 is engaged and the first plunger 124 has moved 0.129 inches (0.33 cm), the first switch 80 starts to close by cam action on the switch. A spring reaction on the cantilever blade 108 of the first switch 80 causes the cam follower 112 to trail the quickly falling first cam 146 and make a connection with the stationary blade 88. The first switch 80 is a high voltage switch, and in order to minimize arcing, the first cam 146 is designed to allow a speedy connection when the brake pedal 21 is engaged. Also, when the brake pedal 21 is disengaged, and the first switch 80 is re-opened, the first cam 146 quickly removes the two contacts so that as little arcing as possible will occur. When arcing does occur across the contacts of the first switch 80, the capacitor 70 installed in the capacitor box 66 of the housing cover filters interference signals caused by arcing. This filtering prevents disturbances that occur in an automobile's audio system because of interference signals caused by arcing.

Cam action on the cam followers 112 causes the second switch 82 to start to open after the first plunger 124 has moved about 0.173 inches (0.44 cm). The third switch 84 opens after the second plunger 126 has moved about 0.129 inches (0.33 cm), and the fourth switch 86 begins to open after about 0.277 inches (0.705 cm) of movement by the second plunger 126. Disengagement of the brake pedal 21 causes the pedal to return to its disengaged position where the plunger shafts 130 150 are depressed into the housing 24 with only 0.030 inches (0.075 cm) of each shaft emerged from the housing.

Referring to FIGS. 15, 16, 17, and 19, operation of the multiple plunger pedal switch assembly 20 under the second application is now described. Operation under the second application is similar to operation under the first application, except the printed circuit board 164 replaces the third 84 and fourth 86 switches, the third plunger 160 replaces the second plunger 126, and the E 118, F 102, G 104 and H 120 terminals are replaced by J 182, K 184, L 186 and M 188 terminals which are soldered to the printed circuit board. Interaction of the printed circuit board 164 and the third plunger 160 determines circuit resistance characteristics. In the disengaged position, the two arms 170 of the first multi-finger wiping 190 contact bridge the conductive ink 180 paths attached to the J 182 and K 184 terminals to act as a closed switch. As the pedal is engaged and the third plunger 160 begins to move within the housing 24, one arm 170 of the first multi-finger wiping contact 190 moves toward the non-conductive ink 194 connected to the J terminal 182. When the plunger 160 has moved between 0.129 inches (0.33 cm) and 0.169 inches (0.43 cm) in the housing 24 the first multi-finger wiping contact 190 reaches the non-conductive ink 194, and no signal can be transferred across the J 182 to K 184 terminals because one arm 170 of the first multi-finger wiping contact 190 is in contact with non-conductive ink. Thus, the J 182 and K 184 terminals behave as a switch that is closed when the brake pedal is disengaged, but is open when the brake pedal has moved between 0.129 inches (0.33 cm) and 0.169 inches (0.43 cm) from the disengaged position.

The second multi-finger wiping contact 192 serves to bridge the L 186 and M 188 terminals. When the brake pedal 21 is in the disengaged position, the voltage drop across the L 186 and M 188 terminals is relatively small because there is little resistance between the two terminals. But when the plunger 160 begins to move within the housing 24, the arm 170 of the multi-finger wiping contact 192 that touches the resistive ink 196 slides further into the resistive ink, and a greater voltage drop is created across the L 186 and M 188 terminals because of the increased resistance. The voltage drop continues to increase across the two terminals as the multi-finger wiping contact 192 slides further along the resistive ink 196. When the pedal is disengaged, the plunger 160 causes the multi-finger wiping contact 192 to reverse its slide along the resistive ink, and the voltage drop returns to a relatively small amount. The analog signal created across the L 186 and M 188 terminals is linearly related to the distance of brake pedal 21 depression, and the signal is useful in communication with an on board computer.

What is claimed is:

1. A multiple plunger pedal switch assembly, comprising:

(a) a housing;

(b) a switch carrier engaging the housing to mount the multiple plunger pedal switch assembly to a stationary surface;

(c) at least two switches enclosed in the housing to operate an electrical device; and (d) at least two concentric plungers that are separate and operate independently from each other, spring biased, and slideably carried in the housing, each plunger having at least one cam and a shaft such that each cam selectively engages a switch for switch operation when the plunger causes the shaft to move within the housing.

2. The multiple plunger pedal switch assembly as in claim 1 wherein the plungers include a first plunger and a second plunger, the first plunger has a crescent shaft and the second plunger has a post shaft which is concentric to the crescent shaft.

3. The multiple plunger pedal switch assembly as in claim 1 wherein the plungers have cams that are ramp shaped and interact with switch cam followers to operate the switches.

4. The multiple plunger pedal switch assembly as in claim 1 where the concentric plungers operate switches that are configured for electrical redundancy to improve reliability such that activation of only one of the switches is necessary to operate an electrical device.

5. The multiple plunger pedal switch assembly as in claim 1 wherein the switches comprises a stationary blade, a spring blade, and electrical contacts.

6. The multiple plunger pedal switch assembly as in claim 5 wherein at least one spring blade is comprised of a blade base, two cantilever arms with cam followers for sliding along the cams on the plunger, and electrical contacts, the two cantilever arms producing a bifurcated circuit and thus reducing the probability of switch failure.

7. The multiple plunger pedal switch assembly in claim 1 wherein the electrical device operated by the switches is a circuit that activates or deactivates automobile devices.

8. The multiple plunger pedal switch assembly as in claim 7 wherein the automobile device is selected from a group consisting of: brake lamps, cruise control, anti-lock braking system, torque converter clutch, and transmission switch interlock.

9. The multiple plunger pedal switch assembly in claim 1 wherein the housing is comprised of four quadrilateral sides, a housing cavity, threaded edge ribs, and two separate retention ribs on opposing sides of the housing.

10. A multiple plunger pedal switch assembly, comprising:

(a) a housing;

(b) a switch carrier which retains the housing to mount the multiple plunger pedal switch assembly to a stationary surface;

(c) at least two switches enclosed in the housing to operate an electrical device; and (d) at least two concentric plungers that are separate and operate independently from each other, spring biased, and are slideably carried in the housing, a first plunger having a cam to operate a switch and a third plunger having electrical contacts to slideably engage a printed circuit board to vary resistance in an electrical circuit when the third plunger moves within the housing.

11. The multiple plunger pedal switch assembly as in claim 10 wherein the third plunger with attached contacts slides along the printed circuit board as the plunger moves in the housing to produce a voltage across two terminals that is related to pedal movement.

12. The multiple plunger pedal switch assembly as in claim 10 wherein the contacts attached to the spring biased plunger are multi-finger wiping contacts.

13. A multiple plunger pedal switch assembly comprising:

(a) a housing;

(b) a switch carrier which retains the housing to mount the multiple plunger pedal switch assembly to a stationary surface;

(c) at least two switches enclosed in the housing to operate an electrical device; and (d) a capacitor carried by the housing to filter electrical interference caused by arcing in at least one of the switches.

14. The multiple plunger pedal switch assembly in claim 13 wherein the capacitor is connected in parallel to at least one of the switches.

15. The multiple plunger pedal switch assembly in claim 13 wherein the capacitor is a film capacitor that is cubical in shape.

16. The multiple plunger pedal switch assembly in claim 13 wherein the capacitor has a capacitance in range from 0.27 MFD to 0.39 MFD, and a voltage rating of 250 VDC.

17. The multiple plunger pedal switch assembly in claim 13 wherein the capacitor is carried in a capacitor box that is integral to the housing.

18. The multiple plunger pedal switch assembly in claim 17 wherein the capacitor box has spring contacts that electrically connect the capacitor in parallel with the switch.

19. The multiple plunger pedal switch assembly in claim 17 wherein the capacitor box has a holding clip to prevent the capacitor from sliding out of the capacitor box.

20. The method of operating switches within a housing upon force applied to a brake pedal, comprising the steps of:

(a) providing a pedal switch assembly comprising:

(1) a housing;

(2) a switch carrier which retains the housing to mount the pedal switch to a stationary surface;

(3) at least two switches enclosed in the housing to operate an electrical device; and (4) at least two concentric plungers that are spring biased, separate and operate independently of each other, and slideably carried in the housing, (b) moving the plungers by application of force to a foot pedal;

(c) operating at least one switch by each plunger when each plunger moves within the housing; and (d) actuating electrical devices upon switch operation.

21. The method of claim 20 wherein the step of operating switches by virtue of plunger movement comprises, (a) movement of a first plunger having a cam, such that a cam follower on one of the switches causes the switch to open or close; and (b) movement of a second plunger having a cam, such that a cam follower on one of the switches causes the switch to open or close.

22. The method of claim 20 wherein the step of operating switches is accomplished by movement of a third plunger having contacts that slide along conductive ink on a printed circuit board to determine circuit resistance characteristics.

23. The method of claim 20 wherein the step of providing a pedal switch assembly further comprises a capacitor, carried by the housing, that filters the electrical interference caused by arcing in at least one of the switches.

* * * * *